United States Patent [19]

Wu et al.

[11] Patent Number: 4,494,556

[45] Date of Patent: Jan. 22, 1985

[54] PNEUMATIC CONVEYING TOBACCO DRYING APPARATUS

[75] Inventors: Dan T. Wu, Jeffersontown; Kevin R. Korte, Louisville, both of Ky.

[73] Assignee: Brown & Williamson Tobacco Corporation, Louisville, Ky.

[21] Appl. No.: 391,882

[22] Filed: Jun. 24, 1982

[51] Int. Cl.[3] ..... A24B 3/18

[52] U.S. Cl. ..... 131/302; 131/303; 131/304

[58] Field of Search ..... 131/302, 303, 304

[56] References Cited

U.S. PATENT DOCUMENTS

| | | | |
|---|---|---|---|
| 3,357,436 | 12/1967 | Wright | 131/303 |
| 4,167,191 | 9/1979 | Jewell et al. | 131/303 |
| 4,407,306 | 10/1983 | Hibbitts | 131/303 |

*Primary Examiner*—Vincent Millin

*Attorney, Agent, or Firm*—Charles G. Lamb

[57] ABSTRACT

An apparatus for drying tobacco includes a heater for heating a drying and conveying gas to a predetermined temperature sufficient to dry the tobacco to a predetermined moisture content, a tobacco-gas separator device of the short residence type located downstream of the heater, a first duct establishing gas flow communication between the hot gas outlet from the heater and the entrance to the tobacco-gas separator device, and a tobacco feed device located substantially at the entrance to the separator device for introducing tobacco to be dried into the duct at the entrance to the separator device. In addition, an apparatus of the class described wherein the tobacco to be dried and the drying gas are separately introduced into the separator device.

6 Claims, 2 Drawing Figures

PNEUMATIC CONVEYING TOBACCO DRYING APPARATUS

BACKGROUND OF THE INVENTION

1. Field of the Invention

This invention relates, in general, to a system for drying tobacco, and more particularly to a system for drying tobacco while providing for a minimal tobacco residence time in the drying apparatus.

2. Description of the Prior Art

Pneumatic tobacco conveyor dryer systems are known to the art. However, the dryer systems known to us have a number of drawbacks.

Three such systems are illustrated in U.S. Pat. No. 3,357,436 issued on Dec. 12, 1967 to A. H. Wright; U.S. Pat. No. 3,409,025 issued on Nov. 5, 1968 to W. Wochnowski; and U.S. Pat. No. 3,786,573 issued on Jan. 22, 1974 to John J. Scheppe and Raymond N. Carini.

U.S. Pat. No. 3,357,436 shows a tobacco drying apparatus having an air heater interconnected to a tobacco-air separator by means of a long duct forming a serpentine flow path, vertically oriented, drying chambers. The tobacco to be dried is introduced into the duct upstream of the serpentine flow path. As the heated tobacco bearing air flows upwardly through the drying chambers, the tobacco is dried.

U.S. Pat. No. 3,409,025 also shows a tobacco drying apparatus having an air heater interconnected to a tobacco-air separator by means of an inverted U-shaped duct. The tobacco to be dried is introduced into one of the vertical arms of the U-shaped duct downstream of the heater. The tobacco travels upwardly in this arm, changes direction through the bend of the duct and moves downwardly in the other arm to the separator device.

U.S. Pat. No. 3,786,573 illustrates a drying device having a heater interconnected to a separator by a long duct. Tobacco to be dried is introduced into this duct near the outlet from the heater. Controlled louvers are formed in the duct between the location whereby the tobacco is introduced and the entrance into the separator. The louvers are used to introduce a controlled amount of ambient air into the duct to control the temperature of the dried tobacco.

A common drawback of all of these systems is the extended residence time of the tobacco in the system. The longer the tobacco is kept in a system, the longer it is subjected to the drying effects of the air resulting in a chemical loss, particularly a loss of alkaloids.

A further drawback common to the apparatus of U.S. Pat. Nos. 3,357,436 and 3,409,025 is the curved or serpentine path which requires the tobacco bearing air to make directional changes as it moves to the separator. These directional changes have basically two disadvantageous effects. As the tobacco bearing air changes flow direction, some of the tobacco will be centrifuged out of the air stream. At least some of this centrifuged tobacco will build up along the curved walls of the duct, necessitating a cleaning of the duct from time to time to avoid clogging. Furthermore, the directional changes in the flow of the tobacco bearing air causes the tobacco to, at least partially, break-up.

SUMMARY OF THE INVENTION

The present invention recognizes the drawbacks of the prior art systems and provides a straightforward solution.

One object of the present invention is to provide a pneumatic conveyor drying apparatus for drying tobacco requiring a minimal tobacco residence time in the apparatus.

Another object of the present invention is to provide a pneumatic conveyor drying apparatus wherein the tobacco bearing air stream moves in a straight path without any changes in direction as it moves to the separator.

A further object of the present invention is to provide a pneumatic drying apparatus of the class described which is compact in overall size thereby requiring a minimum of space in a manufacturing facility and, therefore, which is relatively inexpensive to fabricate and maintain.

A still further object of the present invention is to provide a pneumatic conveyor drying apparatus which will dry virtually any type of tobacco regardless of its precondition such as, for example, expanded tobacco and freshly cut tobacco.

More particularly, the present invention provides an apparatus for drying tobacco comprising heater means for heating gas passing therethrough; a short duration solids-gas separator device located downstream of the heater means; first duct means fluidly interconnecting the hot gas outlet of the heater means and the entrance of the separator device for establishing gas flow communication therebetween; tobacco feed means located substantially immediately at the entrance of the separator device for introducing tobacco to be dried into the apparatus substantially at the entrance of the separator device; gas moving means located upstream of the gas inlet of the heater means, and in gas flow communication with the gas inlet of the heater means; and second duct means for establishing gas flow communication between the gas outlet of the separator device and the gas inlet of the gas moving means for recirculating the gas separated from the tobacco in the separator device back to the gas moving means.

The present invention also provides a method of drying tobacco comprising introducing tobacco solids into a solids-gas separator, and introducing tobacco drying gas into said solids-gas separator separately from said introduction of the tobacco solids to be dried.

BRIEF DESCRIPTION OF THE DRAWING

These and other features of the present invention will be made even more clear upon reference to the following specification and accompanying drawing wherein.

DETAILED DESCRIPTION OF THE PREFERRED EMBODIMENT

Figure 1:
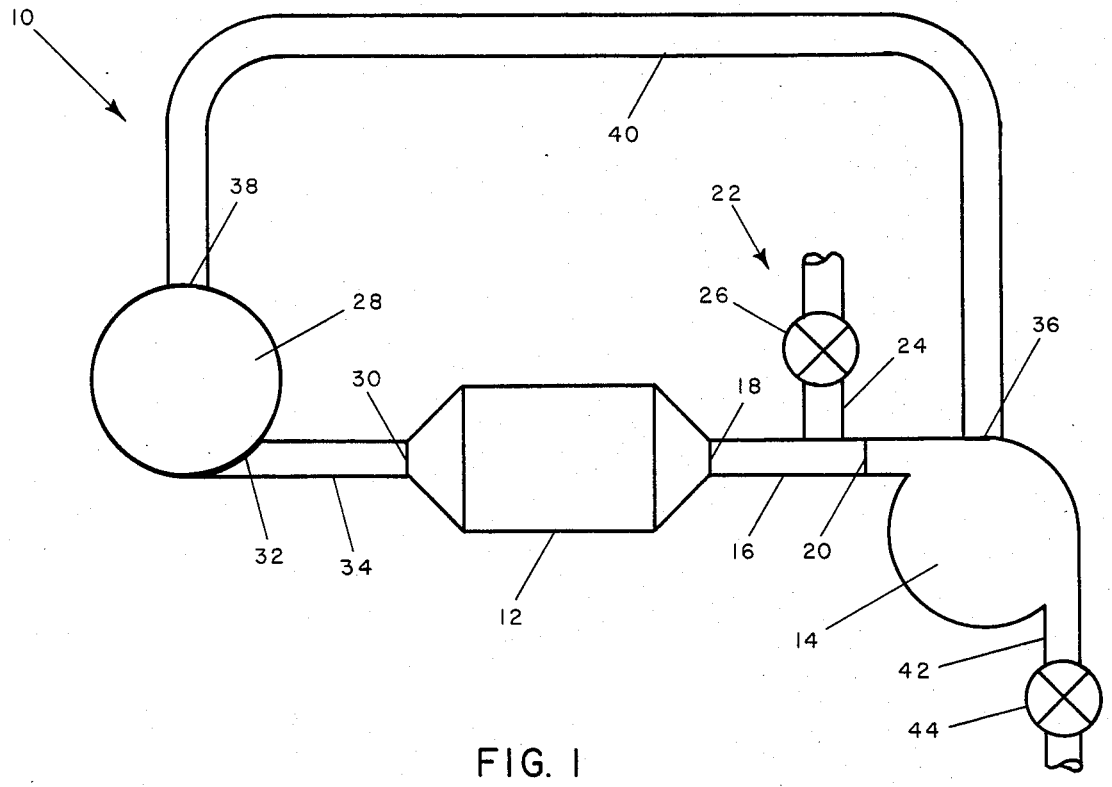
FIG. 1 is a schematic representation of one preferred embodiment of an apparatus for pneumatically conveying and drying tobacco embodying the features of the present invention.

With reference to the schematic illustration of FIG. 1, there is shown a pneumatic tobacco conveying and drying apparatus, generally denoted as the numeral 10, for drying tobacco to a predetermined moisture content embodying the features of the present invention.

The pneumatic conveying and drying apparatus 10 is depicted as comprising heater means 12, which can be of virtually any type, such as a natural gas-fired burner or electric heater, for heating a tobacco drying and conveying gas, such as air or a mixture of air and steam, and a short duration tobacco-conveying gas separator device 14 preferably of the tangential-type. A first duct 16 interconnects a hot conveying gas outlet 18 of the heater means 12 to an entrance 20 of the tangential separator device 14, thus, establishing fluid flow communication between the heater means 12 and separator device 14.

Tobacco feed means 22 is located substantially at or immediately adjacent the gas entrance 20 of the separator device 14 so that tobacco to be dried is introduced into the duct 16 substantially at the entrance 20 into the separator device 14. The tobacco feed means 22 comprises a feed channel 24 open to the duct 16 and an air lock device 26 such as, for example, a rotary valve.

The feed means 22 is to be located immediately at the entrance 20 into the separator device 14 with only whatever space therebetween which may be necessary to accommodate a coupling of the duct 16 to the entrance of separator device 14. It should also be noted that the flow path from the tobacco feed means 22 to the separator entrance 20 is substantially straight.

Conveying gas moving means 28, such as a fan or blower, is located upstream of a conveying gas inlet 30 of the heater means 12. The conveying gas outlet 32 of the moving means 28, at the high pressure side of the conveying gas moving means 28, is in flow communication with the conveying gas inlet 30 of the conveying gas heater means 12 by means of a duct 34.

Gas flow communication between the conveying gas outlet 36 of the tangential separator device 14 and the conveying gas inlet 38 of the moving means 28, at low pressure side of the conveying gas moving means 28 is established by means of a duct 40 for recirculating the conveying gas separated from the tobacco in the tangential separator device 14 to the conveying gas moving means 28.

The dried tobacco exits the tangential separator device 14 through a tobacco outlet 42 for subsequent processing. The tobacco outlet 42 is provided with air lock means, for example, a rotary valve 44.

In operation, tobacco drying and conveying gas, such as air, is continuously recirculated through the apparatus 10 by the conveying gas moving means 28. As the conveying and drying gas moves through the heater means 12, it is heated to between about 400° F. and about 800° F. The heated tobacco drying and conveying gas moves from the heater means 12 through the first duct 16 to the tangential separator 14. Tobacco to be dried is introduced into the heated conveying gas stream through the feed means 22 substantially at the entrance 20 of the separator 14. Thus, tobacco is subjected to the heated conveying gas only, virtually concurrently with the tobacco-conveying gas separation process taking place in the separator device 14. The separated, dried tobacco leaves the separator device 14 through the tobacco outlet 42 for subsequent processing and the separated conveying gas is recirculated through the duct 40 back to the heating means 12 for reuse.

Figure 2:
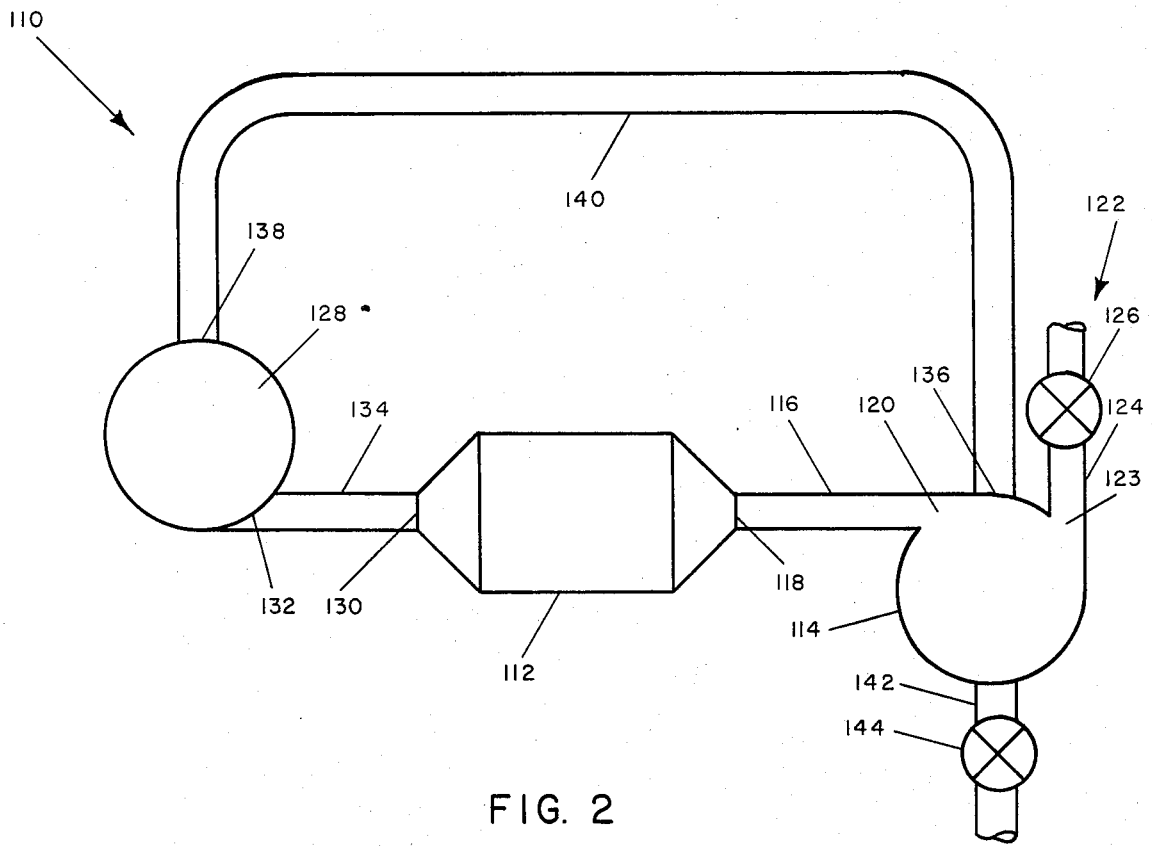
FIG. 2 is a schematic representation of another preferred embodiment of an apparatus for pneumatically conveying and drying tobacco embodying the features of the present invention.

FIG. 2 illustrates another advantageous embodiment of a pneumatic conveying and drying apparatus, generally denoted as the number 110, which is depicted as comprising heating means 112, which can be of virtually any type such as, for example, a natural gas-fired burner or electric heater for heating a tobacco drying and conveying gas, such as air or a mixture of air and steam, and a short duration tobacco-conveying gas separator device 114 preferably of the tangential-type. A first duct 116 interconnects the hot conveying gas outlet 118 of the heating means 112 to the gas entrance 120 of the tangential separator device 114, thus, establishing conveying gas flow communication between the heating means 112 and separating device 114.

Tobacco feed means 122 is located at a tobacco entrance 123 of the separator device 114. The tobacco feed means 122 is shown as comprising a tobacco feed channel 124 generally tangential and open to the tobacco entrance 123 of the separator device and an air lock device 126 such as, for example, a rotary valve.

Conveying gas moving means 128, such as a fan or blower, is located upstream of the conveying gas inlet 130 of the heating means 112. The conveying gas outlet 132 of the moving means 128, at the high pressure side of the conveying gas moving means 128, is in flow communication with the conveying gas inlet 130 of the conveying gas heater means 112 by means of a duct 134.

Gas flow communication between the conveying gas outlet 136 of the tangential separator device 114 and the conveying gas inlet 138 of the conveying gas moving means 128, at the low pressure side of the conveying gas moving means 128 is established by means of a duct 140 for recirculating the conveying gas separated from the tobacco in the tangential separator 114 to the conveying gas moving means 128.

The dried tobacco exits the tangential separator device 114 through a tobacco outlet 142 for subsequent processing. The tobacco outlet 142 is provided with air lock means, for example, a rotary valve 144.

In operation, tobacco drying and conveying gas, such as air, is continuously recirculated through the apparatus 110 by the conveying gas moving means 128. As the conveying and drying gas moves through the heater means 112, it is heated to between 400° F. and about 800° F. The heated tobacco drying and conveying gas moves from the heater means 112 through the first conduit 116 and into the tangential separator 114 through the gas entrance 120 of the tangential separator 144. Tobacco to be dried is introduced into the tangential separator 114 from the tobacco feed means 122 through the tobacco entrance 123 of the separator 114. Thus, the tobacco is subjected to the heated conveying gas only while it is in the tangential separator 114. Therefore, the tobacco has a minimum residence time in the apparatus. The separated, dried tobacco leaves the separator device 114 through the tobacco outlet 142 for subsequent processing, and the separated conveying gas is recirculated through the duct 140 back to the heating means 112 for reuse.

The apparatus of the present invention thus provides for a minimum of tobacco residence time in the drying apparatus, an apparatus which does not require a change in direction of the tobacco bearing air, an apparatus which is compact in overall size requiring a minimum of space in a manufacturing facility and an apparatus of the class described having a mimimum surface area resulting in less heat loss than heretofore known tobacco drying apparatus.

The foregoing detailed description is given primarily for clearness of understanding and no unnecessary limitations are to be understood therefrom for modifications will become obvious to those skilled in the art upon reading this disclosure and may be made without departing from the spirit of the invention or scope of the appended claims.

The invention claimed is:

1. An apparatus for drying tobacco particles comprising:

heater means for heating tobacco drying and conveying gas passing therethrough;

a short duration tobacco-gas separator device located downstream of said heater means;

first duct means fluidly interconnecting the hot tobacco drying and conveying gas outlet of said heater means and the entrance of said separator device for establishing gas flow communication therebetween;

tobacco solids feed means located at the entrance of said separator device for introducing tobacco particles to be dried into the apparatus at the entrance of the separator device so that simultaneous drying of tobacco solids and separation of tobacco solids from said drying gas occur in said separation device;

gas moving means located upstream of the gas inlet of said heater means and in gas flow communication with the gas inlet of said heater means; and second duct means establishing gas flow communication between the gas outlet of said separator device and the gas inlet of said gas moving means for recirculating the gas separated from said tobacco particles in said separator device back to said gas moving means.

2. The system of claim 1, wherein said heater means heats the tobacco drying and conveying gas to a temperature in the range of about 400° F. to about 800° F.

3. The system of claim 1 wherein said separator device is a tangential gas-solids separator.

4. The system of claim 1, wherein the tobacco bearing drying and conveying gas moves in a substantially straight path from said tobacco solid feed means to the entrance of said separator.

5. The apparatus of claim 1, wherein said separator device comprises:

a tobacco drying and conveying gas entrance; and a tobacco solids entrance separate from said tobacco drying and conveying gas entrance.

6. A method of drying tobacco comprising:

introducing tobacco solids to be dried into a solids-gas separator; and introducing tobacco drying gas simultaneously with said introducing tobacco solids into said solids-gas separator separately from said introduction of the tobacco solids to be dried whereby said tobacco is dried in said solids-gas separator.

* * * * *